United States Patent [19]

Elsis

[11] Patent Number: 4,510,632

[45] Date of Patent: Apr. 16, 1985

[54] CHILDREN'S GAME POOL

[76] Inventor: Christopher C. Elsis, 3720 19th Ave. SW., Naples, Fla. 33999

[21] Appl. No.: 433,716

[22] Filed: Oct. 12, 1982

[51] Int. Cl.[3] ..... E04H 3/18

[52] U.S. Cl. ..... 4/488; 4/489; 4/496; 4/506

[58] Field of Search ..... 4/488, 487, 506, 507, 4/508, 509, 492, 490, 489, 496, 504, 505, 513, 514

[56] References Cited

U.S. PATENT DOCUMENTS

| | | | |
|---|---|---|---|
| D. 254,572 | 3/1980 | Reineman | 4/488 |
| 3,373,450 | 3/1968 | Brooks | 4/488 X |
| 3,421,162 | 1/1969 | Diemond et al. | 4/513 |
| 3,497,877 | 3/1970 | Diemond et al. | 4/513 |
| 3,633,221 | 1/1972 | Addison et al. | 4/513 |
| 3,793,653 | 2/1974 | Brooks | 4/513 |
| 3,908,205 | 9/1975 | Chase | 4/513 |

*Primary Examiner*—Henry K. Artis

*Attorney, Agent, or Firm*—Merrill N. Johnson

[57] ABSTRACT

A wading pool in which children are provided with various games. In plan view the pool is shaped like a Greek cross to provide four similar compartments each sized to accommodate one child. Each of the four compartments is made of a different colored plastic and includes an open topped storage bin on one side of the compartment. Each bin houses a toy water pistol permanently attached to the pool by a hose which permits the water pistol to be removed from the bin and freely operated by the child located within the compartment.

4 Claims, 4 Drawing Figures

CHILDREN'S GAME POOL

BACKGROUND AND SUMMARY OF THE INVENTION

Plastic wading pools for summer use by children are in wide use. These pools are constructed either of plastic film supported upon a framework or rigid molded plastic which can be set up in the yard and filled with from twelve to twenty inches of water by a garden hose. The pools usually are circular or oval in overall shape and from five to more than twelve feet in diameter.

Despite the popularity of these plastic wading pools, they often fail to occupy the interest of children for any extended period of time. A major reason for this lack of extended interest is that the pool itself, after the child's initial pleasure in being cooled off by the water, offers no features that will hold the interest of most children. This leads to the children repeatedly getting in and out of the pool, playing with the hose, trying to let the water out of the pool, and engaging in other undesirable activities which require correction and increased adult supervision to prevent injury to the children and damage to the pool and the yard.

It is an object of my invention to provide a unique wading pool which will hold the interest of children over extended periods of time, thereby increasing their pleasure in the use of the pool and decreasing the likelihood of damage to the pool and its surroundings. It is a further object to provide a wading pool which requires less continuous adult supervision of children using the pool.

In plan view my pool is shaped like a Greek cross so as to provide four similar open-sided compartments, each compartment sized to accommodate one child. Each of these four compartments is constructed of a different colored plastic material preferably red, blue, green and yellow. Each compartment has affixed to one side of the compartment an open topped storage bin whose top lies several inches above the surface of the water in the pool. Each of the bins houses a toy water pistol that is permanently attached to the pool by a length of hose which permits the water pistol to be removed from the bin and freely maneuvered by a child located within the compartment.

In addition to the water pistol stored within the bin, each bin may contain one or more balls, boats and/or other floatable toys preferably of the same color as the compartment.

A wading pool constructed and equipped in accordance with my invention permits each child to have a personal space or "cave" which, due to its size and distinctive coloring, gives the child a sense of security and individuality in relation to other children in the pool. He or she is ready to participate in games in which his skills are pitted against those of the other children.

The child's feelings of security and identity are enhanced by the toy water pistol which is stored in the open topped storage bin on one side of the child's compartment. The pistol is permanently attached to the pool by a flexible plastic hose, the opposite end of which is open beneath the surface of the water in the pool to provide an endless supply of water to the pistol.

Thus the pistol can be removed from its storage bin by the child and used to "defend" his compartment or to play various games in competition with other children in their respective compartments in the pool. To this end, each storage bin may also house several floatable toys used in playing some of the games.

For example, each bin may contain a ball and a boat, each colored to match the color of one of the compartments. The balls are hollow and of such size that they can be moved about the surface of the water in the pool by the force of streams of water squirted from the water pistols. The four balls are placed in the middle of the pool. The object of the game is for a child to move his colored ball into the compartment of another child by using only streams of water from his pistol.

Another game uses four differently colored plastic boats, each having an open top which when filled with water will sink to the bottom of the pool. In this game all four boats are placed in the middle of the pool. The object of the game is for a child, by using only his water pistol, to fill the other children's boats with sufficient water to cause them to sink before his own boat is sunk.

The foregoing examples of games which can be played in my uniquely designed and equipped pool will keep children happy and busy in the pool for extended lengths of time without continuous adult supervision.

DETAILED DESCRIPTION OF THE INVENTION

Figure 1:
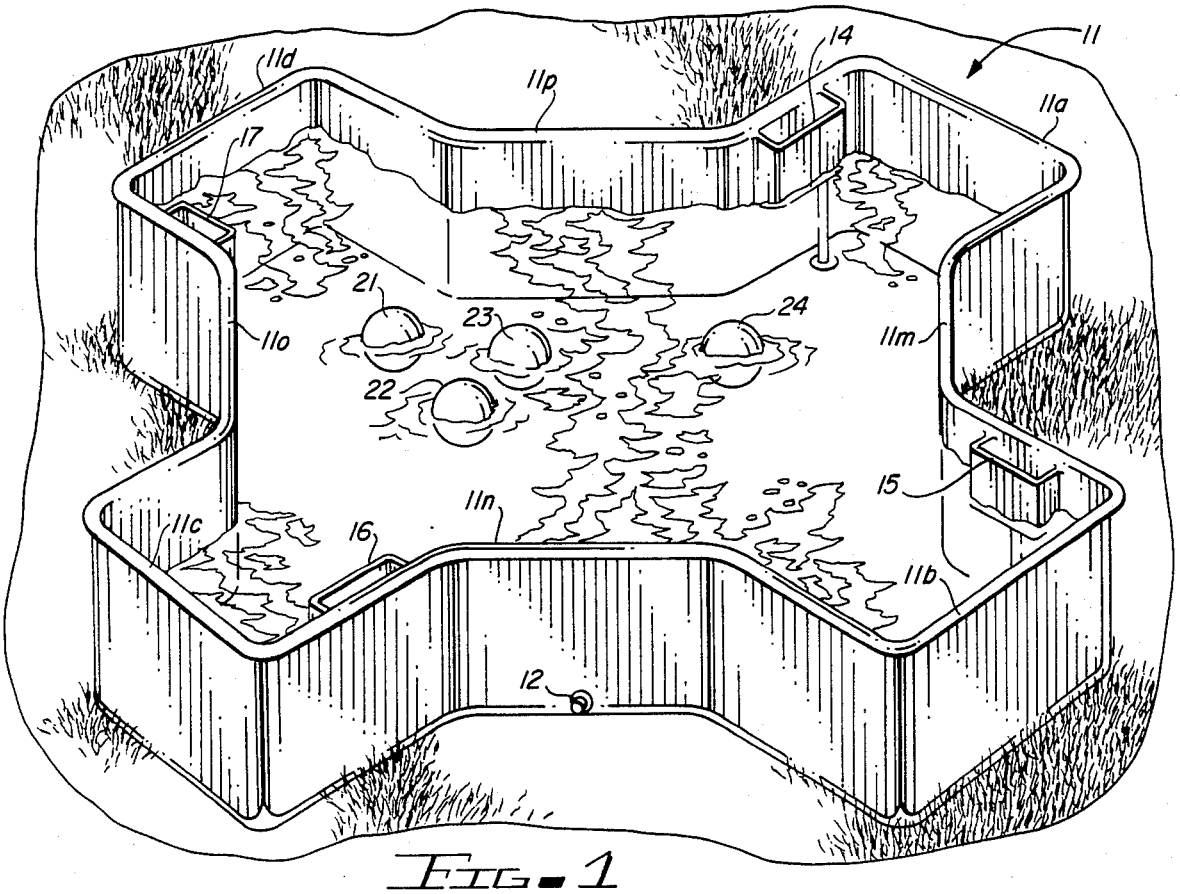
FIG. 1 is a perspective view of my children's game pool showing the storage bins in each of the pool's four compartments.

Referring to FIG. 1 of the drawings, my unique children's game pool 11 is shown set up on a substantially flat grassy surface. The body of the pool is made from a plastic material either in the form of a collapsible film which is supported upon a tubular framework or a rigid molded plastic structure which requires no supporting framework. Children's wading pools of these types are well known and the details of their construction form no part of my invention.

My invention lies in the unique shape and arrangement of the pool that transforms a conventional children's summer wading pool into a game area where the children are not only cooled by the water but are provided with a game area which will keep them constructively occupied for extended periods of time with minimal adult supervision and minimal chance of injury.

Figure 2:
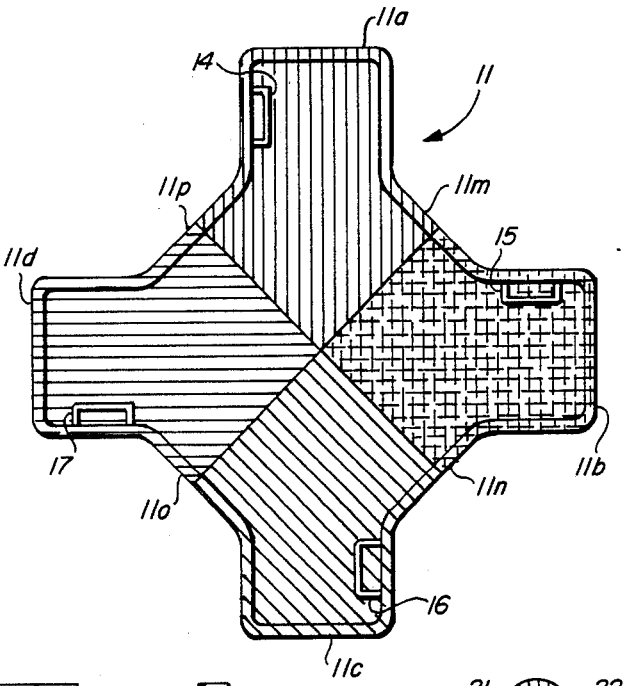
FIG. 2 is a plan view of the pool shown in FIG. 1 color coded to show the distinctive colors of the pool's four compartments.

Pool 11 is constructed as best shown in plan view in FIG. 2 in the shape of a modified Greek cross wherein the ends of the four arms of the cross form four compartments 11*a*, 11*b*, 11*c* and 11*d* or "caves" each large enough to comfortably house a sitting or kneeling child. In order to maintain a large open area in the center of pool 11, the four compartments are interconnected by four similar side walls 11*m*, 11*n*, 11*o* and 11*p* which on the outside of the pool intersect the sides of the four compartments 11*a*, 11*b*, 11*c* and 11*d* at an angle of 135°.

The sides and bottoms of each of compartments 11*a*, 11*b*, 11*c* and 11*d* and the adjoining side walls and bottom of the pool are distinctively colored. Preferably compartment 11*a* is constructed from red material;

compartment 11*b* from yellow; compartment 11*c* from green; and compartment 11*d* from blue material, as shown in FIG. 2 which is color coded. The purpose of these colors is to permit the child occupying a given compartment to visually identify himself with that color and differentiate him from the other children. This accentuates the identity assumed by the child from his separate "cave" and sets the stage for the child's participation in various games to be played within the pool.

Pool 11 is provided with a conventional drain plug 12 near the bottom of side wall 11*n* to facilitate draining the pool after it has been used. To prepare the pool for use, it is filled with water to about two-thirds of its height, which is preferably in the order of 15 to 30 inches or more.

Figure 3:
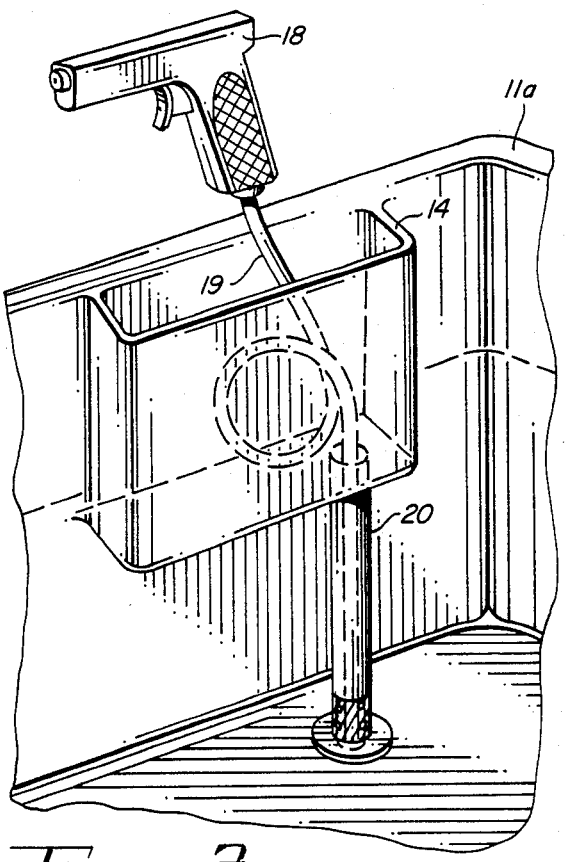
FIG. 3 is a detailed broken away view showing one of the water pistols affixed to the pool.

Each pool compartment has along one of its sides an open topped storage bin shown as bins 14, 15, 16 and 17 in FIGS. 1 and 2. Each is made of plastic material permanently attached to a wall of the compartment with its open top flush with or somewhat below the upper edge of the compartment as shown in FIG. 3. Each bin is large enough to house a toy water pistol such as pistol 18 shown in FIG. 3 and its attached length of hose 19, as well as several floatable plastic toys such as balls and boats.

The water pistol 18 stored in each bin is of a conventional type which can be held in the hand of a child and by pressing its trigger will eject or squirt a jet or stream of water a considerable distance. A length of flexible plastic hose 19 is permanently attached to the handle of the pistol. The opposite end of hose 19 has its open end permanently affixed to a tube 20 which has a series of holes in its lower end and which runs from the bottom of bin 14 to the bottom of pool 11. This arrangement provides a continuous supply of water to the pistol 18 which can be freely manipulated by the child in compartment 11*a*. The length of hose 19 restricts use of the pistol to a child sitting or kneeling in the compartment, and the pistol cannot be lost or removed from the pool.

Figure 4:
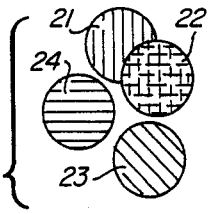
FIG. 4 shows the four colored balls used for games in the pool as shown in FIG. 1.

Bins 14, 15, 16 and 17 provide convenient storage for pistols not in use and also are capable of storing several toys such as balls 21, 22, 23 and 24 shown in FIGS. 1 and 4. Preferably the balls are colored to match the red, yellow, green and blue coloring of the four pool compartments. The bins may, of course, be used to store other toys such as boats and favorite playthings of the individual child using the pool.

Children using my game pool will not only be cooled off by the water as in conventional wading pools but will enjoy a sense of identity and comfort in the brightly colored compartments and in addition will have a handy "weapon" to "defend" their spaces. Moreover, the pool constitutes a play area for various games and fantasies suggested both by supervising adults and the children themselves.

While I have shown and described a preferred embodiment of my children's game pool, certain modifications and changes in construction will be apparent to those skilled in the art. Accordingly, my invention is limited only by the spirit and scope of the appended claims.

I claim:

1. A children's game pool comprising:

a flat bottomed pool constructed essentially entirely of plastic material, said pool having vertical side walls and being shaped in plan view like a modified Greek cross so as to form four similar three-sided compartments within the interior of said pool, said four compartments each having permanently affixed to the interior of one side wall of the compartment an open topped storage bin, and a toy water pistol storable within said bin and permanently attached to said pool by a flexible hose.

2. A children's game pool according to claim 1 in which the four compartments are constructed of differently colored plastic material.

3. A children's game pool according to claim 1 in which the open top of the storage bins affixed to a side wall of each compartment lies in substantially the same horizontal plane as the upper edge of the pool.

4. A water-retaining flat bottomed children's game pool integrally formed of plastic material, said pool having a plurality of vertical side walls arranged in plan view in the shape of a Greek cross so as to form four similar three-sided compartments within the interior of said pool, and an open topped storage bin formed of plastic material permanently affixed to the interior of one side wall of each of the four compartments.

* * * * *